US006786275B2

(12) United States Patent
Dey et al.

(10) Patent No.: US 6,786,275 B2
(45) Date of Patent: Sep. 7, 2004

(54) HEAT EXCHANGER HEADER ASSEMBLY

(75) Inventors: Lavoyce Dey, Youngsville, PA (US); Jonathan Fitzgerald, Warren, PA (US); Michael Powers, Lakewood, NY (US)

(73) Assignee: Valeo Engine Cooling, Rochester Hills, MI (US)

( * ) Notice: Subject to any disclaimer, the term of this patent is extended or adjusted under 35 U.S.C. 154(b) by 0 days.

(21) Appl. No.: 10/152,852

(22) Filed: May 23, 2002

(65) Prior Publication Data

US 2003/0217838 A1 Nov. 27, 2003

(51) Int. Cl.[7] ..... F28F 9/02; F28D 1/00

(52) U.S. Cl. ..... 165/173; 165/176; 165/153; 165/149

(58) Field of Search ..... 165/173, 176, 165/149, 153, 906; 29/890.043, 890.052, 840.054

(56) References Cited

U.S. PATENT DOCUMENTS 3,612,264 A * 10/1971 Trunick ..... 206/449
5,152,339 A * 10/1992 Calleson ..... 165/173
5,190,101 A * 3/1993 Jalilevand et al. ..... 165/176
5,390,733 A * 2/1995 Young ..... 165/173
5,457,885 A * 10/1995 Ohashi et al. ..... 165/153
5,873,409 A * 2/1999 Letrange et al. ..... 165/173
5,944,095 A * 8/1999 Fukuoka et al. ..... 165/173
6,065,533 A * 5/2000 Woodhull, Jr. ..... 165/149
6,189,606 B1 * 2/2001 Chevallier ..... 165/173
6,216,777 B1 * 4/2001 Rhodes et al. ..... 165/176
6,263,570 B1 * 7/2001 Cazacu ..... 29/890.043
6,357,521 B1 * 3/2002 Sugimoto et al. ..... 165/173

* cited by examiner

*Primary Examiner*—Henry Bennet
*Assistant Examiner*—Tho Duong
(74) *Attorney, Agent, or Firm*—Liniak, Berenato & White

(57) ABSTRACT

A manifold for a heat exchanger comprising a tank, a plurality of tubes arranged to receive fluid therein, a plurality of fins for interspacing the tubes, the fins extending along the length of the tubes to thereby define a core section, wherein the header section is formed with multi-point brazing interfaces for securing said header and said core section during a brazing process. One embodiment provides at least one doubled wall area in close proximity to the tube slot areas to form a structure of increased strength, permitting the material to be reduced in relative thickness. The manifold may be formed from flat sheet stock by extended side walls of the header portion joined by a separate cap to close a top portion of the manifold assembly for the purpose of collecting fluid to and from the tubes and said at least one inlet and outlet. For a plastic manifold, the header section is formed with an inner wall defining an extended tube slot area of a header well to receive the plastic tank foot portion thereby increasing the strength of the structure.

8 Claims, 6 Drawing Sheets

Fig. 9a
Fig. 9b
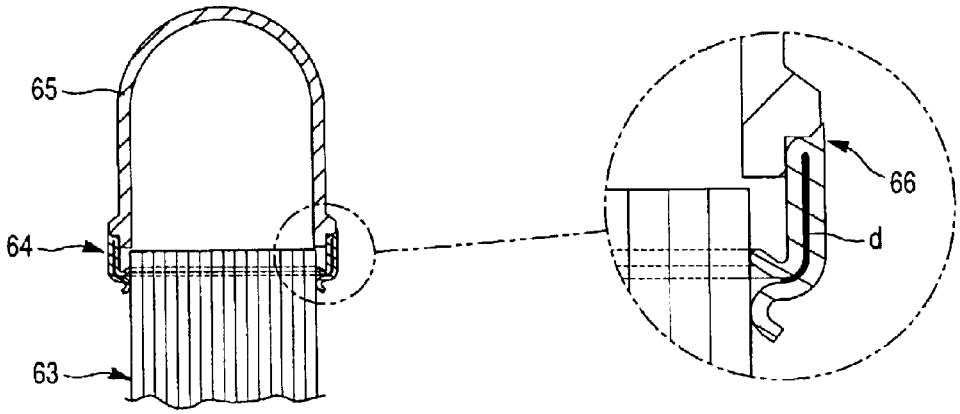
Fig. 10a
Fig. 10b
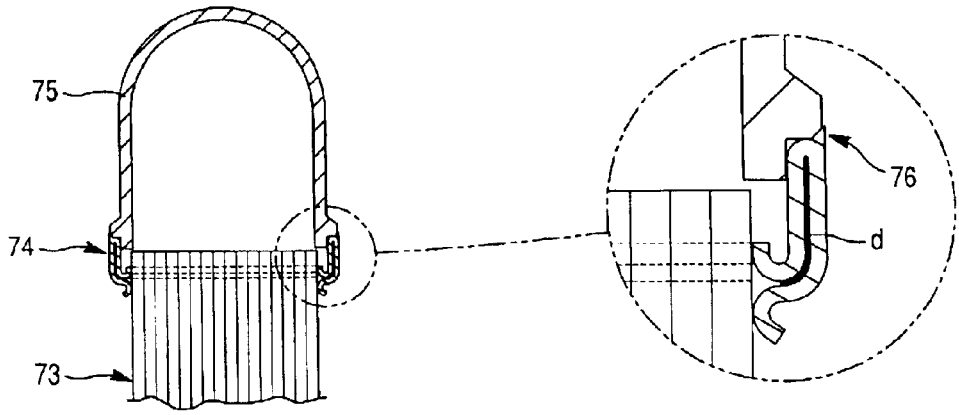

HEAT EXCHANGER HEADER ASSEMBLY

FIELD OF THE INVENTION

The present invention relates to headers for heat exchangers, and more particularly, to a manifold and header assembly and method of manufacture of the same resulting in improved strength while reducing cost and packaging.

BACKGROUND OF THE INVENTION

Heat exchangers for vehicles and stationary combustible engine power plants are known to have a header and a tank connected by tubes interspaced by fins, with sideplates providing rigidity. In this type of heat exchanger the fins provide a large surface area for heat transfer and support for the tubes.

Such heat exchangers may be used as radiators or plate oil coolers. They may also be used in a number of other applications including charged air coolers.

The typical, modern, automotive and truck brazed heat exchangers consist of a fin and tube assembly called the core. The tubes are attached to headers on opposing ends of the core. The whole assembly is baked in an oven to bond together the fins, tubes, and header. The remaining tank portions are attached to the headers to form manifolds by any of a number of retaining features, such as welding or a mechanical crimping process, depending on the header design, the environment and the material composition of the tank portion.

Conventionally, the header is stamped from sheet stock and resembles a rectangular tray with edges folded upward approximately 90° from the bottom surface. The bottom surface contains many punched oval and/or rectangular slots to accommodate the core tubes. The header slots are recessed formed upwards, pierced and/or a collar is formed upwards to guide the tube into the header slots. The shape formed around the tube slots is sometimes called ferrules or collars.

Headers meant to accommodate plastic molded tanks have a trough formed into the perimeter of the rectangular area to accept the foot of the plastic tank and a gasket. Also, retaining features are formed into the edges to facilitate the crimping operation for the tank retention at the tank foot.

The current manifold requires substantially increased packaging space along the direction from grill to engine. Cast Aluminum tanks require increased material thickness, due to the material's ability to withstand higher pressures and the molding process, which leads to added weight and cost. The durability of the tube-to-header joint is limited and usually needs to be reinforced.

Additional operations after brazing are required to weld the cast tank and/or to retain the plastic tank with gasket to the header.

Design limitations of cast tanks limit bracket features and other hardware attachment options due to molding process and cost impact. The header gauge is increased to overcome the unsupported bending moments between the vertical wall of the header and the horizontal portion where the tubes are inserted in the slots.

The need therefore exists to reinforce the core tube entry junction to the header where the prime mode of failure are thermal, primarily failing in the tube radius at the header braze junction near the end tube on the inlet side.

Additionally, the need exists for a manifold design resulting in substantial weight savings, reduced vehicle package size, and reduced manufacturing costs.

SUMMARY OF THE INVENTION

This invention provides a manifold having improved strength produced from flat sheet stock with reduced wall thickness requirements.

One purpose of this invention is to provide a stronger manifold in the sheet metal header area near the ends of the core tubes. In accordance with this invention, the manifold has reduced material weight and manufacturing costs, while retaining the functional performance with current materials and manufacturing brazing process capabilities.

The advantage of the manifold design described below is improved thermal performance, substantial weight savings, reduced vehicle package size, and reduced cost to manufacture.

The header of this invention provides manufacturing options not available in traditional designs. Formed tube slots provide more surface contact area with the tubes for added braze strength. Return bends in the header material serve to reinforce the tube-to-header joint and to strengthen the header itself. The cross section of the design has a narrower footprint resulting in space savings for the final product. The design can be adapted to accommodate multiple manifold options including a one-shot braze concept or a plastic tank, both of which yield weight savings.

The reverse bending of the header flange exploits the inherent strength of the core by forming a bond to the core. The bond, consisting of double manifold material, creates a truss-like formation with the core because the clad material and subsequent brazed joint on the interior of the double wall further enhances strength and durability. The combination of the ribs and gussets formed into the manifold and the aforementioned bond creates a structural union unobtainable by the manifold alone.

The header flange material is approximately doubled and juxtaposed along the tubes by reverse bending the material back and approximately against itself forming a substantial portion of the sides of the manifold, which is then closed with a cap. The sidewalls and cap areas may be contoured to specific vehicle packaging constraints.

The new header incorporates trusses, ribs and gussets and doubled walls to improve the structural integrity of the heat exchanger manifolds. The turbulator is bonded to the inside of the core tube during the brazing operation forming trusses to make the area around the tube more rigid and allow the thermal and pressure loads to be more evenly distributed across many tubes. The tube slot, which is formed in the header, bonds to outer surface of the core tube as well as to the inside of the header wall forming ribs and gussets. The core tube bonds to the reverse header flange forming another gusset. General fatigue is reduced due to the improved structural integrity and reduced mass in the manifold.

The combinations of the structural shapes when brazed together form compound gussets and trusses, thus permitting the use of thinner header material gauges for better brazing results, reduced cost and less weight. The header and cap may be ribbed and/or have tie bars incorporated into key locations in order to increase the manifold's ability to withstand the internal pressure with thinner gauge materials.

Another versatile aspect is multiple manifold designs and material options including a one-shot braze design in addition to the cast aluminum and plastic tank designs already in use. The one-shot braze tank consists of a formed cap joined to the header prior to the braze process hence bonded to the header during braze.

The doubled wall is applicable to multiple manifolds such as cast metal tanks or those made from flat sheet stock.

The single wall is applicable to multiple manifolds such as those using plastic tanks where the inner wall at the tank foot is restricted from rotating during retaining or pressure cycling because of the increased rigidity of the tube and slot ferrule wall.

In the all sheet metal stock manifolds, additional operations required after brazing with certain manifold options such as mechanical retention of the tab over the tank foot or welding the tank to the header are eliminated.

The cost of the sheet metal manifold assembly is reduced compared with the cast tank manifold.

The overall manifold tank thickness is reduced in the completed heat exchanger assembly by folding the header back into a doubled wall allowing reduced vehicle packaging in the grill-to-engine direction.

The overall assembly has a reduced weight using the all sheet metal stock manifold but retains the strength required to withstand the pressure.

The double wall being juxtaposed to the tube areas near and along the core face form a stronger tube-to-header joint.

The increased header strength allows the header area of the manifold to provide improved structural integrity to withstand the internal pressures and during thermal stress loading.

The all-sheet-metal manifold is environmentally friendly because no disassembly or segregation of materials is required for reclamation.

BRIEF DESCRIPTION OF THE DRAWINGS

FIG. 9*a* is a cross sectional view taken along section plane VI—VI in FIG. 4 except showing the invention as applied to cast tanks, wherein the header doubled wall leg is extended to fit to the tube with a ferruled lead around the tube, the leg is extended to form a lead for the tube entry into a pierced slot, and the double wall is welded to the cast tank after braze.

FIG. 9*b* is an enlarged partial view of the section view of FIG. 9*a*.

FIG. 10*a* is a cross sectional view taken along section plane VI—VI in FIG. 4 except the header doubled wall is formed to fit to the tube with an enhanced ferrule around the tube and is welded to the cast tank after braze.

FIG. 10*b* is an enlarged partial view of the section view of FIG. 10*a*.

DETAILED DESCRIPTION OF PREFERRED EMBODIMENTS

Figure 1:
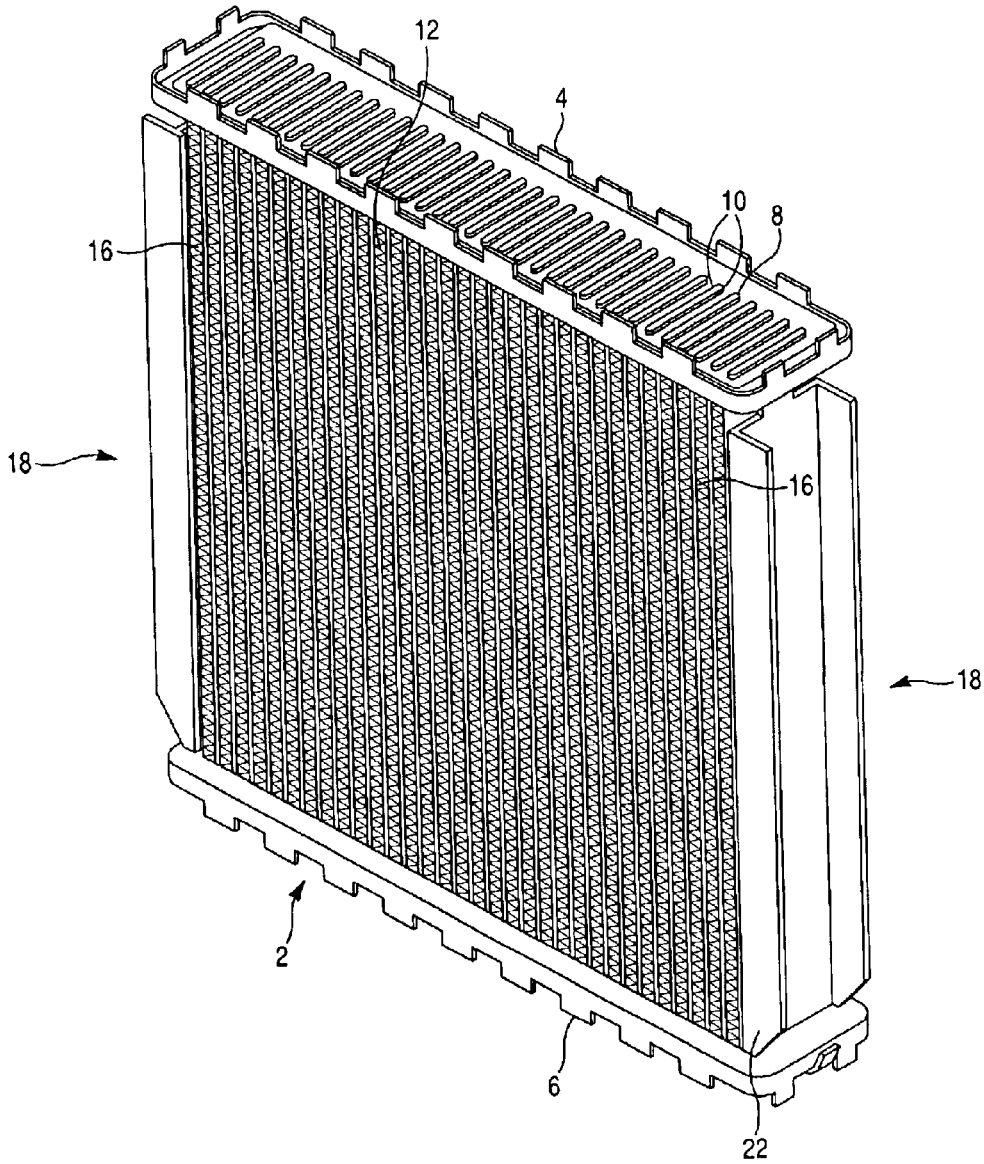
Fig. 1 Prior Art
FIG. 1 illustrates a conventional heat exchanger assembly.

Referring to prior art FIG. 1, a heat exchanger core 2 for a vehicle and/or a stationary combustible engine power plant is shown secured to a top header 4 and a bottom header 6. The core consists of a plurality of tubes 8 spaced by fins 12 and opposing side plates 18. The headers are disposed substantially parallel to one another. The tubes 8 connecting the manifolds are arranged perpendicular to the manifolds. The tubes have a narrow cross-section with rounded or rectangular ends such that the tubes have two substantially flat sides 10. Interspaced between the flat sides 10 of adjacent tubes along substantially the entire length of the tubes is a plurality of serpentine fins 12. There are two outermost tubes, each of which has a set of fins 16 on their outer flat sides. These two sets of fins 16 are secured to the sideplates 18, and the sideplates are secured to the top and bottom headers 4, 6.

In use, coolant flows through the tubes 8 from a manifold formed in part by top header 4 to a tank formed in part by bottom header 6. The fins 12, 16 contact the tubes to provide a large surface area for conducting heat from the coolant. In addition, the fins provide structural support to the tubes 8. This is important since the coolant may be pressurized.

It will be understood that the invention is also applicable to heat exchangers used as charge air coolers, where pressurized air from, for example, a turbocharger, is cooled by passage through the heat exchanger.

Figure 2:
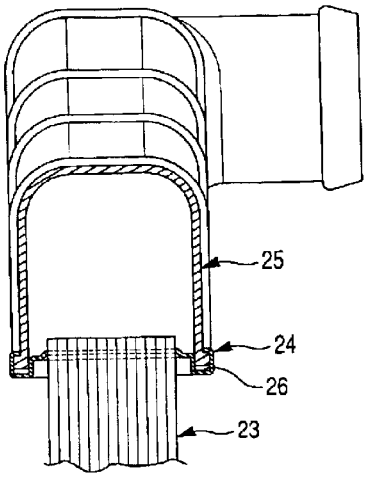
Fig. 2 Prior Art
FIG. 2 illustrates a conventional assembly showing a plastic tank, gasket and header assembly with header crimp tabs retaining the tank.
Figure 3:
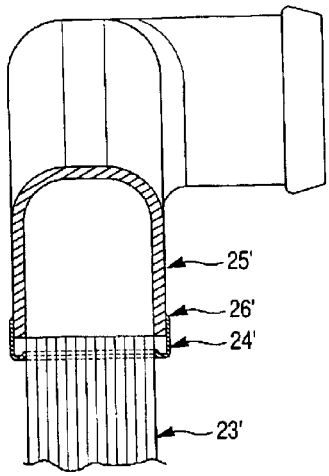
Fig. 3 Prior Art
FIG. 3 illustrates a conventional assembly showing cast tank and header assembly with header to tank weld seam to retain the tank.

FIGS. 2 and 3 illustrate the conventional header stamped from sheet stock. In FIG. 2, the header 24 is designed to mount a plastic molded tank 25 onto a core 23 whereby the header 24 is formed with a trough in the perimeter of the rectangular area to accept the foot of the plastic tank 25 and a gasket 26. Crimp tabs/retention features are formed into the edges above the trough to facilitate the crimping operation for the tank retention at the tank foot. In FIG. 3, the header 24' is designed to receive and mount the foot of a cast (e.g., aluminum) tank 25' onto a core 23', whereby a tank weld seam 26' retains the tank 25' to the header 24'.

Figure 4:
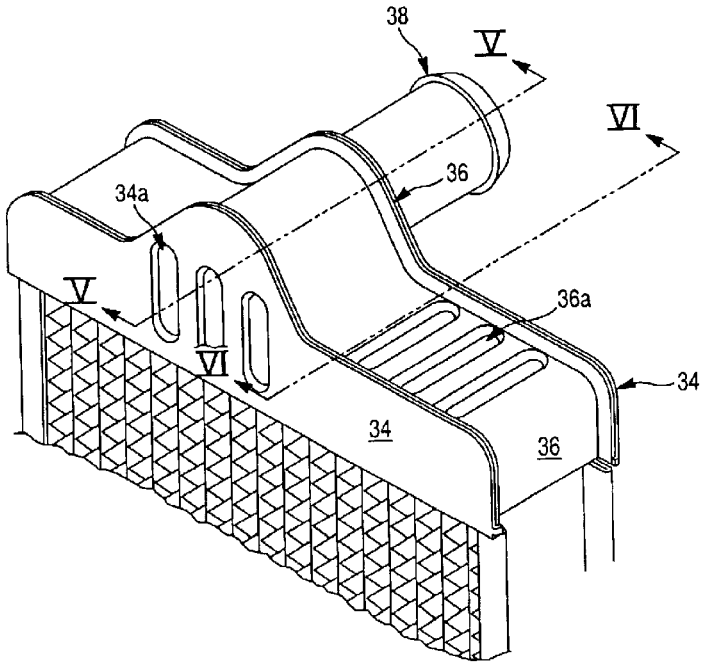
FIG. 4 is an isometric view of the invention in its one-shot braze form.

Turning now to the features of this invention, FIG. 4 illustrates an isometric view of the invention in its one-shot braze design. In FIG. 4, the header 34 is extended upward to form the sides of the manifold area and bonded during the brazing process with a separate cap 36 mounted on the top to form a completed manifold. The cap 36 is added separately to form the top surface of the manifold. No additional manifold assembly operations are required.

Figure 5A:
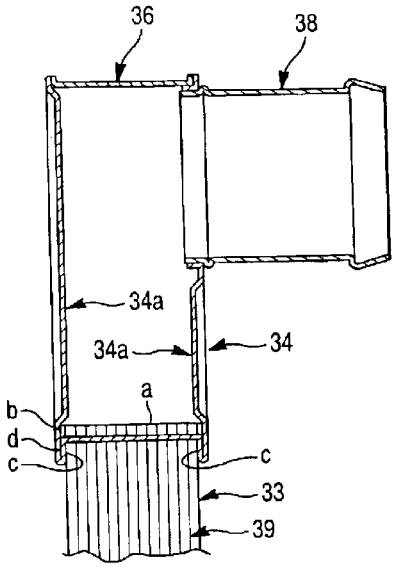
FIG. 5*a* is a cross sectional view taken along section V—V identified in FIG. 4 showing the header portion and cap for the sheet metal manifold through the center of the inlet tube.

With reference to FIG. 5*a*, the inlet or outlet tube 38 is mounted to the manifold assembly 34 and 36 in a conventional manner. For example, the inlet/outlet tube 38 may be staked at a plurality of positions (e.g., 3 stake positions) to secure the tube 38 to the header wall 34 for a brazing operation.

In the preferred embodiment for the one-shot braze, the header 34 and cap 36 incorporate trusses, ribs and gussets (see ribs 34*a,* 36*a* in FIG. 4) and doubled-walled areas (see FIGS. 5*a,* 7 and 8) to improve the structural integrity of the heat exchanger manifolds. The turbulator 39 is bonded to the inside of the core tube 33 during the brazing operation to form trusses to make the area around the tube more rigid and to allow the thermal and pressure loads to be more evenly distributed across the tube.

Figure 5B:
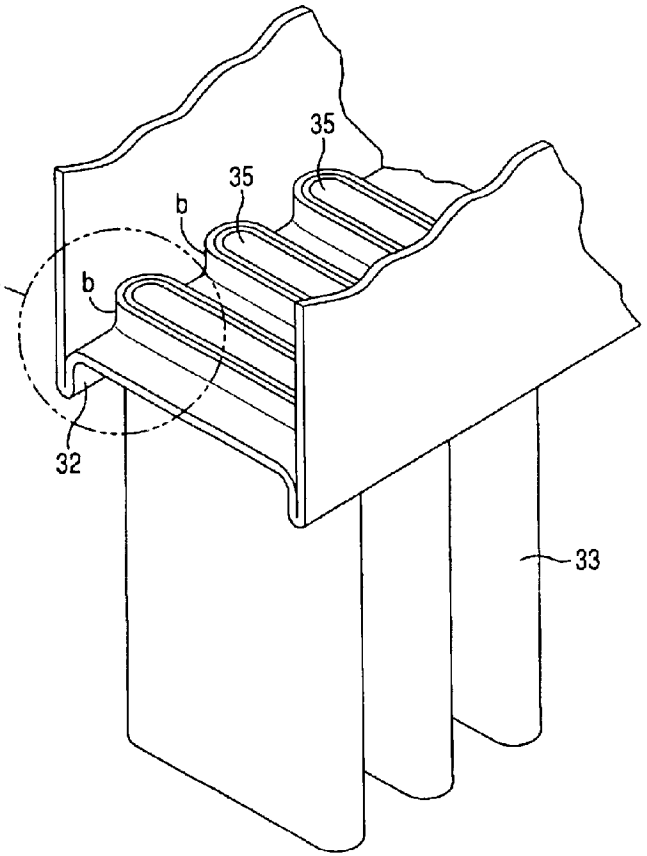
FIG. 5*b* is a perspective view of the header portion illustrated in FIG. 5*a*.
Figure 5C:
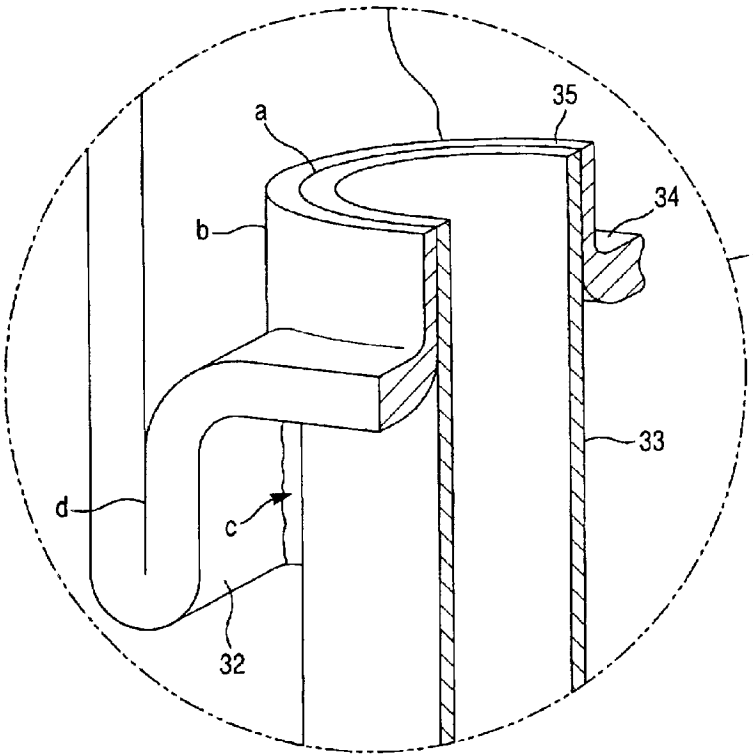
FIG. 5*c* is an enlarged partial view of the header portion shown in FIGS. 5*a* and 5*b*.

The collars 35 define tube slots formed in the header 34. As shown in FIG. 5*c,* the collars 35, bond to outer surfaces of the core tubes 33 (point 'a') as well as to the inside surface of the header wall forming ribs and gussets (point 'b'). The core tube 33 bonds to the reverse header flange 32 (point 'c') forming another gusset. In addition, a further bond, consisting of double manifold material, creates a truss-like formation with the core because the clad material and subsequent brazed joint on the interior of the double bend (point 'd') further enhances strength and durability. Therefore, the invention provides a multi-point brazing interface for securing the header and the core section during a brazing process, whereby general fatigue is reduced due to the improved structural integrity and reduced mass in the manifold.

Notably, the reverse header flange 32 will also bond to the fins or spacers disposed between each tube 33.

Figure 7:
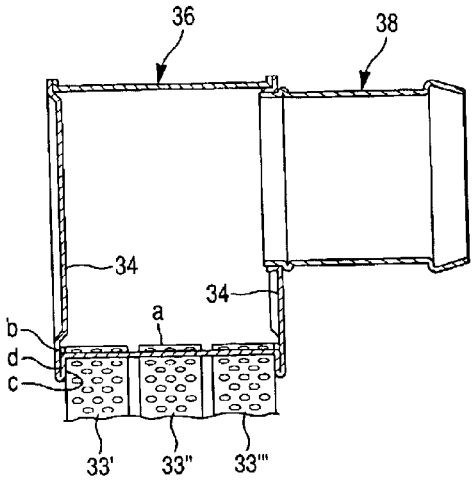
FIG. 7 is a cross sectional view taken along section V—V identified in FIG. 4 showing the inventive header portion and cap for the all-sheet-metal manifold through the center of the inlet tube similar to FIG. 5 except showing multiple tube rows through the header.

FIG. 7 is an illustration similar to FIG. 5*a* showing the header portion 34 and cap 36 for the all-sheet-metal manifold as viewed through the center of the inlet/outlet tube 38 wherein multiple tube rows 33', 33", 33'" are passed through the header. Thus, it is apparent from this embodiment that the header 34 and cap 36 may be designed to accommodate a variety of core sizes.

Figure 6A:
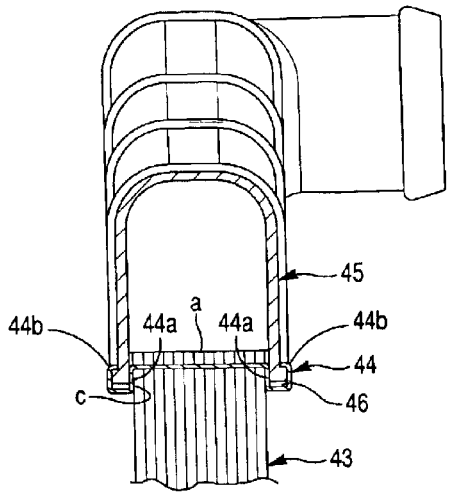
FIG. 6*a* is a cross sectional view taken along section VI—VI identified in FIG. 4 except showing the invention as applied to plastic tanks, wherein the header material forms the tank well with approximately one material thickness separating the tube from the inner tank foot wall.

FIG. 6*a* is a cross sectional view taken along section VI—VI identified in FIG. 4 except showing the invention as applied to plastic tanks 45, wherein the header material 44 forms the tank well with approximately one material thickness separating the tube 43 from the inner tank foot wall 44*a* and crimp tabs 44*b*. As described above with regard to the prior art arrangement, a gasket 46 is disposed in the tank well.

For the arrangement of FIG. 6*a,* the header material 44 defines a reduced width when compared to the header arrangement of the prior art (see FIG. 2). Thus, the cross section of the design has a narrower footprint resulting in space savings for the final product. Moreover, the shape and arrangement of the foot wall 44*a* provides improved stiffness, rigidity and effectiveness during the mechanical retention process. The single wall arrangement of FIG. 6*a* is applicable to multiple manifolds such as those using plastic tanks where the inner wall at the tank foot is restricted from rotating during crimping or pressure cycling because of the increased rigidity of the tube and slot collar/ferrule wall.

Figure 6B:
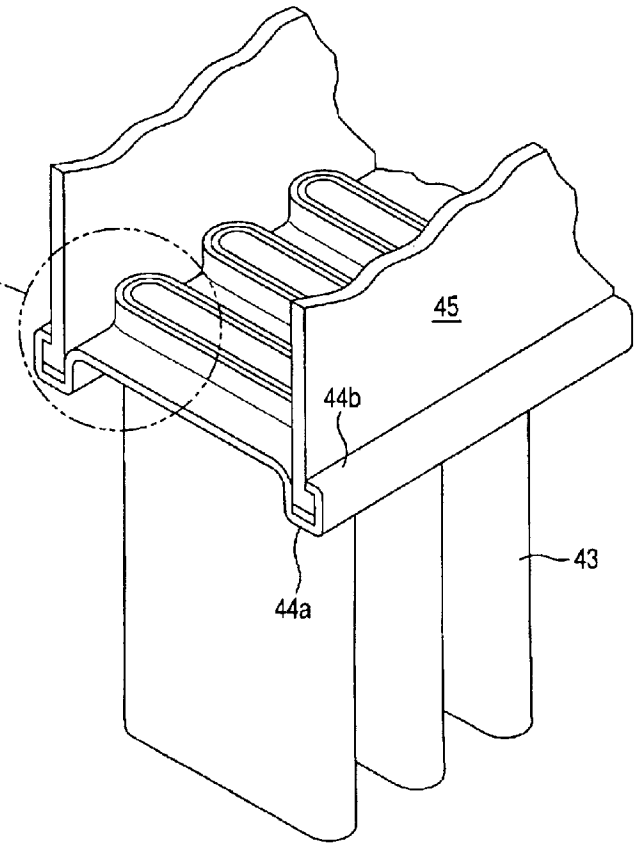
FIG. 6*b* is a perspective view of the header portion illustrated in FIG. 6*a*.
Figure 6C:
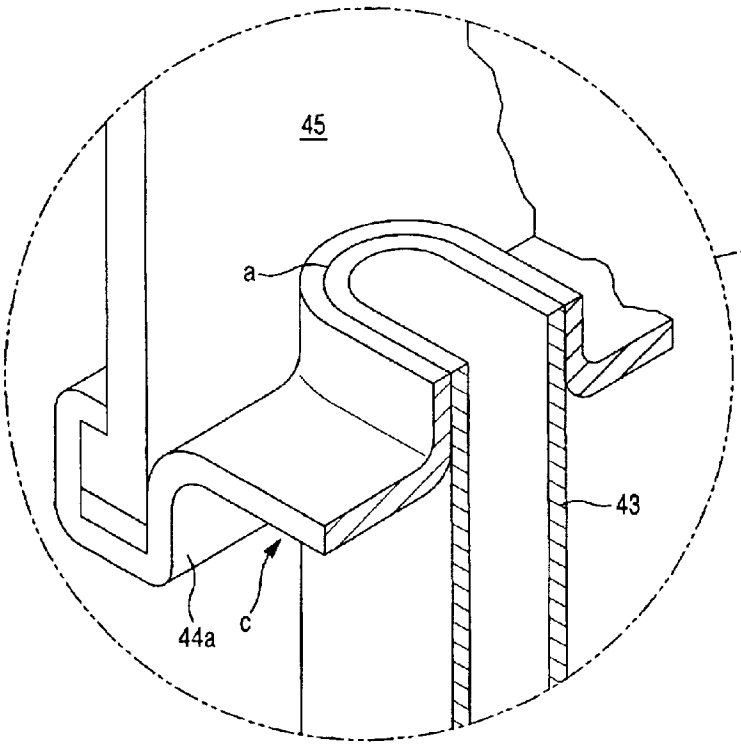
FIG. 6*c* is an enlarged partial view of the header portion shown in FIGS. 6*a* and 6*b*.

As shown in FIGS. 6*b* and 6*c,* the collars, which are formed in the header 44, bond to outer surfaces of the core tubes 43 (point 'a') and the core tube 43 further bonds to the reverse header flange or foot wall 44*a* (point 'c') thereby forming another gusset to provide a multi-point brazing interface for securing said header and the core section during a brazing process. Therefore, general fatigue is reduced due the improved structural integrity.

Figure 8:
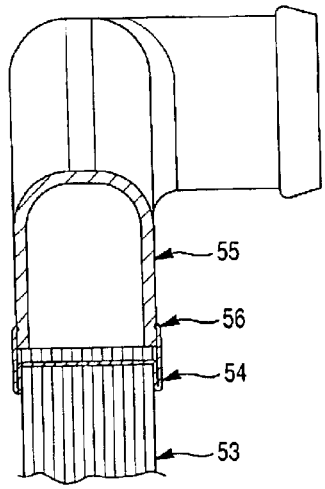
FIG. 8 is a cross sectional view taken along a plane similar to Section VI—VI identified in FIG. 4 except showing the invention as applied to cast tanks, wherein the header material is welded to the cast tank after the brazing process.

FIG. 8 illustrates the invention as applied to cast tanks, wherein the header material 54 is welded to the cast tank 55 after braze. In other words, the header 54 is doubled over and juxtaposed along the tubes and core 53 by reverse bending the header material back and approximately against itself forming an overlapped portion of the sides of the manifold. The brazing process secures the header material 54 to the core 53. A welded seam 56 fixes the cast tank 55 in place after the brazing process is complete.

The reverse bending of the header flange 54 exploits the inherent strength of the core 53 by forming a bond to the core 53. The bond, consisting of double manifold material, creates a truss-like formation with the core 53. The header flange 54 material is approximately doubled and juxtaposed along the tubes by reverse bending the material back and approximately against itself to again provide a multi-point brazing interface between the header and the core section. It is noted that a clad material side is present where tube contacts header and where the header flange is returned bent against itself. Area where the tank is welded to the header is essentially a non-clad surface.

FIG. 9*a* illustrates the invention as applied to cast tanks 65, wherein the header 64 forms a doubled wall leg extended to fit to the core 63 with a ferruled lead around the core 63, whereby the leg is extended to form a lead for the tube/core entry. The double wall is welded (see weld 66) to the cast tank 65 after the brazing process. The header material 64 forms a non-clad surface of non-clad material to improve welding. FIG. 9*b* is an enlarged partial section view of the view of FIG. 9*a* showing the bend ends of the header material 64 whereby the bend ends provide added tube support and a guide surface for the tube/core 63 to enter to the header. In addition, a further bond, consisting of double manifold material, creates a truss-like formation with the core because the clad material and subsequent brazed joint on the interior of the double bend (point 'd') further enhances strength and durability.

FIG. 10*a* is a cross sectional view taken along section lines VI—VI in FIG. 4 except the header 74 includes a doubled walled leg that is formed to fit to the tube/core with an enhanced ferrule around the tube/core 73. The header 74 is welded to the cast tank 75 after the brazing process at weld 76. FIG. 10*b* is an enlarged partial section view of the view of FIG. 10*a*.

As described above with respect to each of the embodiments of the invention, the all-sheet-metal manifold design options provided by this invention result in significant weight savings and reduced costs because the header material and cap material can be made using a one-shot braze design (as shown in FIGS. 4, 5*a* and 7) in which the header material is extended upward to form the sides of the manifold area and bonded during the brazing process with a cap to form a completed manifold. A separate cap is added to form the top surface of the manifold. No additional manifold assembly operations are required.

A header design for plastic tanks (as shown in FIG. 6*a*) that incorporates a trough within the header to accommodate the plastic tank foot and gasket. The tank and tubes are separated by a single wall thickness with the outside wall of the tube slot juxtaposed against the inside wall of the tank foot.

A header design for cast tank designs as (shown in FIGS. 8, 9*a* & 10*a*) in which the header edge provides a surface suitable for welding the cast tank. The ends of the header extend up to form the sides of the manifold.

The tube slots are formed into the header creating ferrules with the clad surface of the ferruled slot toward the core tube to bond to it during brazing. Bonding of this junction during braze, forms a gusset to enhance the manifold to core structure, as opposed to the cut edge of the sheet material commonly used in a traditional design. This provides more contact surface area between the tubes and header increasing the braze strength at the joint.

The header material is formed to bend down along the tube edges in the opposite direction forming tube slots. After a short distance an approximately 180° return bend doubles-up the material thickness along the side of the tube and allows the material to continue up to form a ferrule juxtaposed around the entire perimeter of the tube with the manifold wall formed into a surface for welding. These doubled walls in strategic areas create a highly rigid, high strength header that serves to reinforce the tube-to-header joint because it is bonded to the tubes during braze. The design results in reduced overall header/manifold width, thus providing improved package size.

From the foregoing description, it is clear that this invention provides a unique manifold for a heat exchanger produced from flat sheet stock with the header portion formed with at least one doubled wall at the areas in close proximity to the tube slot areas where the tube and header slot wall is formed with a reverse bend slot wall turned over approximately 180° and juxtaposed to the header vertical wall to form a structure of increased strength, permitting the material to be reduced in relative thickness and where the extended side walls of the header portion are joined by a cap to close forming a manifold assembly for the purpose of collecting fluid to and from the tubes and inlet and outlet ports.

Additionally, the invention provides a manifold assembly for a heat exchanger having a core header portion produced from flat sheet stock forming a pan to receive the tank foot and gasket, whereby the core tube contacts the inner wall of the pan and header slots increasing the strength of the structure where the extended tube slot area is formed upward. The assembly forms the inner portion of a header well to receive a plastic tank foot portion with the header outer portion formed upward and juxtaposed to the outside parallel wall of the tank foot. The wall is preferably formed with means to mechanically retain the tank foot area to a finished brazed core with a gasket compressed in between the tank foot and the opposite header portion to seal the tank to the header for the purpose of collecting fluid to and from the tubes and inlet and outlet ports.

In the one shot brazing embodiment described above, the assembly is formed of comparatively reduced manifold and/or header portion gauge material to provide components of similar mass and/or wall thickness components units to improve braze ability across all conventional brazing lines. An assembly containing components of conventional materials and compatible mass permit the unit to be processed through conventional brazing lines, using conventional tried and proven materials. With this design, the manifold assembly has an overall manifold tank dimension of approximately four times the header material thickness plus the thickness of the core. Moreover, the outer walls of manifold sides may be contoured to package within the vehicle constraints.

For the one shot braze embodiment, the core, manifolds, inlet/outlet connections, etc. are completed in the brazing furnace. The completed unit is tested at the end of the furnace and shipped to customer. The heat exchanger assembly has manifold components made of chemically similar materials such that the core and manifold components can be recycled without requiring disassembly and selective separation of components for environmental recycling of discarded assemblies.

The manifold header assembly designed to receive the tank foot and gasket has an overall manifold tank dimension of approximately four times the header material thickness plus the thickness of the core and two times the tank foot.

In some embodiments, the manifold header assembly has an overall manifold tank dimension of approximately six times the header material thickness plus the thickness of the core.

With all of the aforementioned designs, a formed sheet metal manifold provides a heat exchanger assembly with the flexibility for rapid prototype tooling that can considerably reduce the lead-time to introduce new product to the customer and low volume production manifolds that can be economically produced on this tooling.

A formed sheet metal header provides a heat exchanger core with the flexibility for rapid prototype tooling that can considerably reduce the lead-time to introduce new product to the customer and low volume production manifolds that can be economically produced on this tooling to install cast aluminum tanks after the core is brazed.

While the foregoing invention has been shown and described with reference to numerous embodiments and improvement, it will be understood by those of skill in the art that various changes in form and detail may be made therein without departing from the spirit and scope of the instant invention.

What is claimed is:

1. A manifold for a heat exchanger comprising a plurality of tubes arranged to receive fluid therein, a plurality of fins for interspacing the tubes, the fins extending along the length of the tubes to thereby define a core section, said manifold comprising:

a header section including:

a tray portion;

a plurality of collar raised above said tray portion and defining tube slots through which said plurality of tubes of said core section pass, said tube slots defining a first inner surface providing a first brazing interface with said tubes of said core section; and at least one wall section extending from a periphery of said tray portion, said wall section extending in a downward direction away from said plurality of collars and defining a second inner surface providing a second brazing interface with said plurality of tubes of said core section;

wherein said first inner surface and said second inner surface define a multi-point brazing interface for securing said header and said core section during a brazing process.

2. The manifold according to claim 1, wherein said multi-point brazing interface defines a brazing surface for said plurality of tubes of said core section at an area above said tray portion and below said tray portion.

3. The manifold according to claim 1, wherein the manifold and core section are made of chemically similar materials such that the core section and manifold can be recycled without requiring disassembly and selective separation of components for environmental recycling of discarded assemblies.

4. A manifold for a heat exchanger comprising a plurality of tubes arranged to receive fluid therein, plurality of fins for interspacing the tubes, the fins extending along the length of the tubes to thereby define a core section, said manifold comprising:

a header section including a tray portion;

a plurality of collars raised above said tray portion and defining tube slots through which said plurality of tubes of said core section pass, said tube slots defining a first inner surface facing said tubes of said core section; and at least one wall section extending from a periphery of said tray portion, said wall section extending in a downward direction away from said plurality of collars and defining a second inner surface facing said plurality of tubes of said core section;

wherein said first inner surface and said second inner surface define a multi-point brazing interface for securing said header and said core section during a brazing process, wherein the wall section is formed with at least one doubled wall area adjacent the tube to form a structure of increased strength, permitting the material to be reduced in relative thickness.

5. The manifold according to claim 4, wherein said at least double wall area creates a truss-like formation wit the core section because clad material creates a brazed joint on an interface of the double wall area to further enhance strength and durability.

6. The manifold according to claim 4, wherein said doubled wall area is formed with a reverse bend slot wall folded over approximately 180°.

7. A heat exchanger comprising:

a tank;

a plurality of tubes arrange to receive fluid therein;

a plurality of fins for interspacing the tubes, the fins extending along the length of the tubes to thereby define a core section;

a header section adapted to form at least one of an inlet and an outlet for said fluid, said header section defining a plurality of tube slots through which said tubes pass;

wherein the header section is formed with at least one doubled wall area adjacent the tube slots to form a structure of increased strength, permitting the material to be reduced in relative thickness, said at least one double wall area defines an abutting interface between two walls of said doubled wall area, and wherein said doubled wall area is formed as a reverse bend slot wall bent approximately 180° onto itself.

8. A heat exchanger comprising:

a tank;

a plurality of tubes arrange to receive fluid therein;

a plurality of fins for interspacing the tubes, the fins extending along the length of the tubes to thereby define a core section;

a header section adapted to form at least one of an inlet and an outlet for said fluid, said header section defining a plurality of tube slots through which said tubes pass;

wherein the header section is formed with at least one doubled wall area adjacent the tube slots to form a structure of increased strength, permitting the material to be reduced in relative thickness, wherein the doubled wall area is formed with a downward reverse bend of approximately 180° toward the core section to provide an outer doubled wall header portion extending below the tube slots and wherein the header section is joined with a cast tank cover fit to the header portion and secured by at least on of welding and brazing with respect to the header section to collect fluid to and from the tubes and said at least one inlet and outlet.

* * * * *